US005284171A

United States Patent [19]

Liu

[11] Patent Number: 5,284,171

[45] Date of Patent: Feb. 8, 1994

[54] SUNSHADE OPENING AND SUPPORTING DEVICE

[76] Inventor: Chin-Hsiang Liu, No. 123, Liu Tze Lin, Liu Hsiang Ts'un, Shui Shang Hsiang, Chiayi Hsien, Taiwan

[21] Appl. No.: 986,499

[22] Filed: Dec. 7, 1992

[51] Int. Cl.[5] ..... A45B 11/00

[52] U.S. Cl. ..... 135/20.3; 135/39; 135/41

[58] Field of Search ..... 135/20.3, 37–39, 135/41, 15.1

[56] References Cited

U.S. PATENT DOCUMENTS

| | | | |
|---|---|---|---|
| 2,183,833 | 12/1939 | Farhar | 135/20.3 |
| 3,145,720 | 8/1964 | Torii | 135/20.3 |
| 4,011,881 | 3/1977 | Becher | 135/20.3 |
| 4,132,236 | 1/1979 | Petersen et al. | 135/20.3 X |
| 4,424,824 | 1/1984 | Becher | 135/20.3 |

FOREIGN PATENT DOCUMENTS

| | | | |
|---|---|---|---|
| 2632338 | 12/1989 | France | 135/20.3 |

*Primary Examiner*—Carl D. Friedman
*Assistant Examiner*—Lan M. Mai
*Attorney, Agent, or Firm*—Bacon & Thomas

[57] ABSTRACT

An improved sunshade opening and supporting device is provided with a rack-like member disposed on the main shaft of a sunshade at a section thereof over which the runner of the sunshade travels during the opening and closing of the sunshade; the rack-like member is equipped with a plurality of consecutive Z-shaped teeth each having an oblique face; a horizontal stop piece is disposed at the topmost end of the rack-like member. A groove is disposed on the inner wall of the slidable runner so as to permit the runner to be slidably engaged with the rack-like member; and a cavity is disposed on the wall of the groove of the runner with a spring housed therein. One end of the spring Abuts against a restraint flange of a supporting pin and the other end is limited by a lid secured at one end of the open-ended cavity. A supporting pin having an extended front tip at one end which is led through a through hole disposed at the front of the cavity and is connected to a pivotally operated arc arm pivotally fixed to a lug on the outer wall of the runner at the other end. The extended front tip of the supporting pin is selectively engaged with the teeth of the rack-like member and can disengaged therewith by actuation of the arc arm so as to make the supporting pin retrievably actuated due to the bias spring, causing the sunshade opened and closed readily.

1 Claim, 3 Drawing Sheets

SUNSHADE OPENING AND SUPPORTING DEVICE

BACKGROUND OF THE INVENTION

The present invention relates to an improved opening and supporting device for a sunshade which is equipped with a rack-like member having a plurality of Z-shaped teeth disposed on the main shaft at a specific section over which the runner of the sunshade travels during the opening and closing of the same. A supporting pin housed in a cavity which is provided with a through hole at the front end thereof on the wall of the groove with a spring received therein is connected to an arc arm pivotally secured to a lug disposed on the outer wall of the runner. The bias spring is disposed between a restraint flange disposed on the front portion of the supporting pin and a lid secured to the open end of the cavity. So the actuation of the arc arm connected to the end of the supporting pin which is led through a through hole on the lid can force the supporting pin to move backward against the bias spring and the release of the arm permits the biased spring to push the supporting pin to travel in a reverse direction so as to let the front tip of the supporting pin to selectively engage with one tooth of the racklike member whereby the runner of the sunshade can be automatically retained in place when it is pushed upwardly open, and can be slidably operated downwardly when the pivot arm is actuated to make the supporting pin withdrawn in the cavity, permitting the runner to move downward.

As shown in FIG. 1, a prior art sunshade is provided with a plurality of locking holes 111 on the main shaft 11 thereof on which a runner 12 is slidably located. A plurality of supporting ribs 13 are pivotally connected to the runner at one end and connected to the middle of the frame ribs 14 at the other end so that the upward sliding of the runner will push the sunshade open, and the downward movement of the same will make the sunshade collapse. A top cover 15 is attached to the frame of the sunshade. A supporting pin 132 attached to a chain 131 at one end which is secured to one of the supporting ribs 13 is used to retain the runner 12 in place when the supporting pin 132 is selectively engaged with one of the locking holes 111 with the runner located just above the supporting pin 132 and supported in place by the same.

To collapse the sunshade 1, an operator only has to reverse the steps cited above so as to permit the runner 12, free of the retaining of the supporting pin 132, to move downwardly.

Generally speaking, the conventional sunshade opening device using a supporting pin is able to be operated with ease, but there are still some disadvantages associated therewith in practical operation, which are given as follows:

1. The size of the sunshade is usually very large so that it can keep a wide area covered; the larger the sunshade is the heavier it becomes; an operator has to push the runner upwardly with great effort first with hands and then hold the runner in place with one hand and locate the supporting pin with the other; and the supporting pin is selectively inserted into one of the locking holes as long as the runner is disposed at a desired position and the supporting pin is in alignment with the target locking hole. If not, the operator has to make some adjustments of the location of the runner and the supporting pin. To an operator who is too weak to open the heavy sunshade with one hand, the opening of the same without help from others becomes impossible, causing great inconvenience in practical operation.

2. The main shaft and the runner of the sunshade are slidably engaged with each other and the two are usually assembled together in a loose manner so that the runner can be smoothly moved; but the loose engagement of the runner with the main shaft produces crevice therebetween which can get the fingers of an operator hurt easily when the skin of the fingers is accidentally clamped in the crevice in the collapse of the sunshade.

To overcome the above cited problems, the present inventor has worked out an improved opening and supporting device for a sunshade which is presented in details in the following description along with a number of drawings.

SUMMARY OF THE INVENTION

Therefore, the primary object of the present invention is to provide an improved opening and supporting device for a sunshade which is provided with a rack-like member having a plurality of Z-shaped teeth and disposed at a section of the main shaft of the sunshade and the runner slidably mounted onto the main shaft is provided with a spring biased supporting pin received in a cavity thereon and connected to a pivotally operated arc arm at one end; the tip of the supporting pin is constantly in abutment against the oblique face of the Z-shaped teeth and is able to be urged into the cavity as the runner is pushed upwardly therealong and pop out to support the runner in place each time as the runner passes over one Z-shaped tooth so that the sunshade can be easily opened with the runner constantly retained in place; and it can be readily collapsed by simple actuation of the pivotal arc arm to make the supporting pin disengage with the rack-like member, permitting the runner to be pushed downwardly without restraint.

Another object of the present invention is to provide an improved opening and supporting device for a sunshade which enables a person to open and collapse the sunshade with little effort and safety.

BRIEF DESCRIPTION OF THE DRAWINGS

FIG. 2A is a diagram showing the enlarged portion of the rack-like member of the present invention;

DETAILED DESCRIPTION OF THE PREFERRED EMBODIMENT

Figure 1:
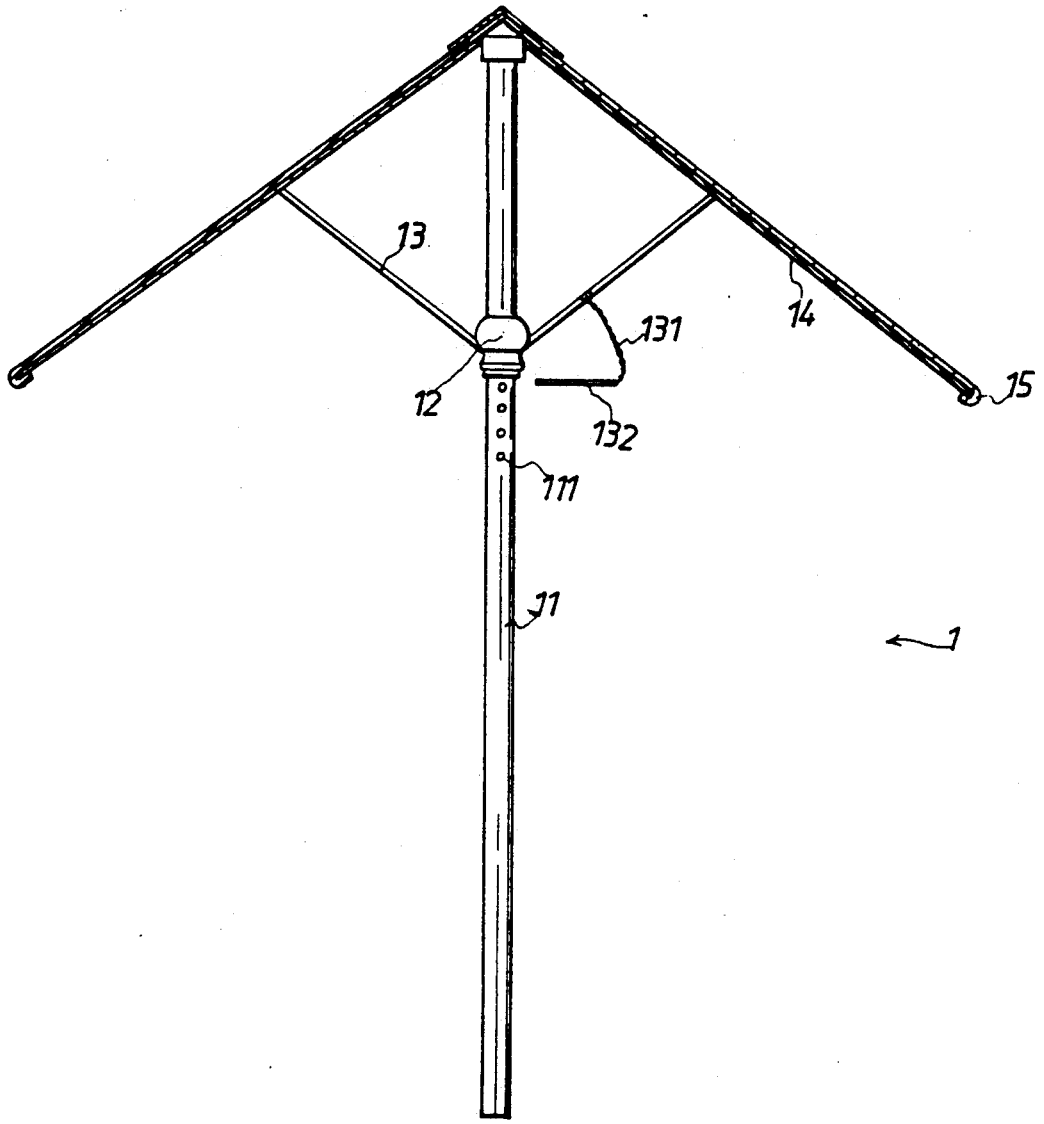
FIG.1 (PRIOR ART)
FIG. 1 is a diagram showing the plane view of a prior art opening and supporting device for a common sunshade.
Figure 2:
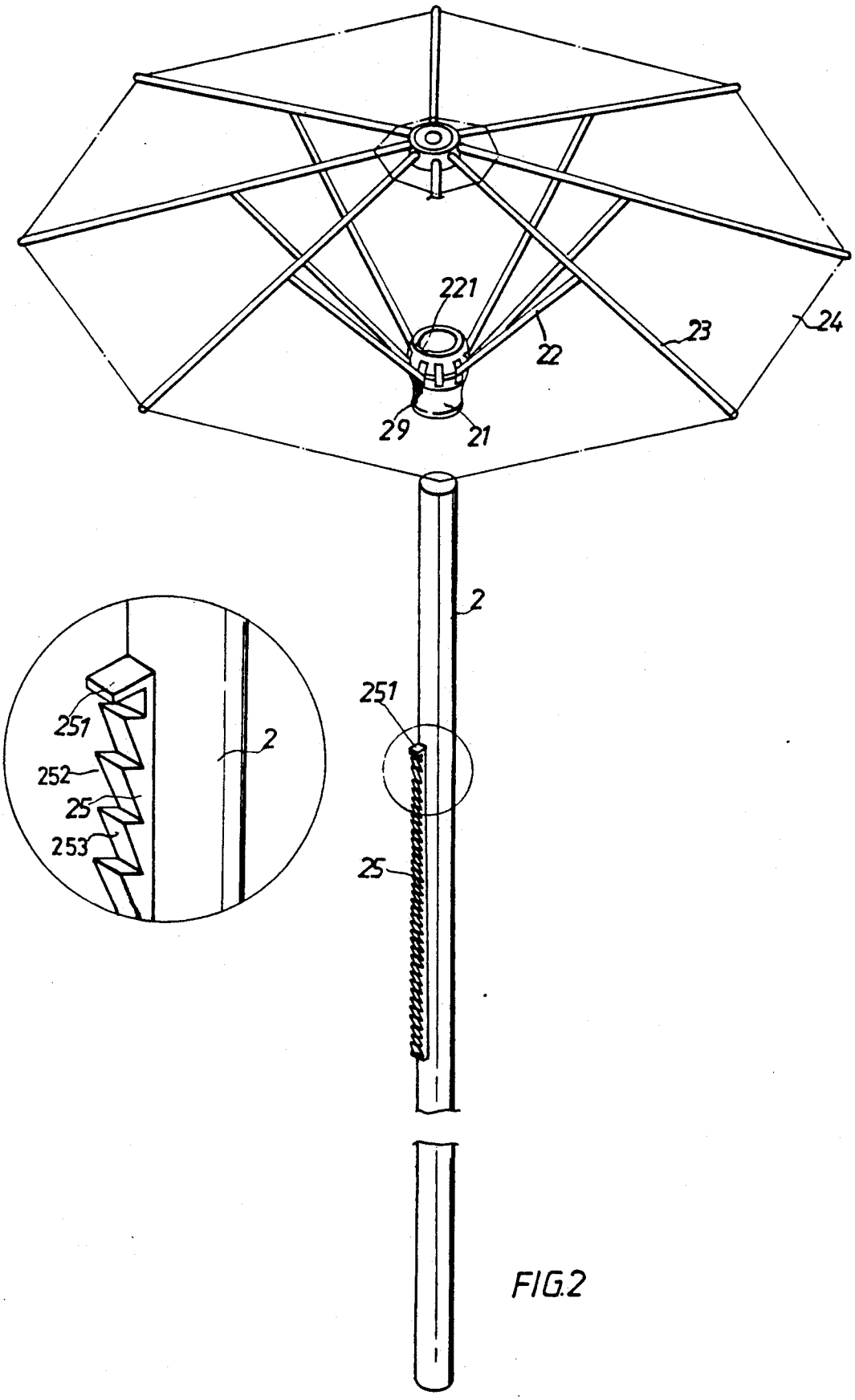
FIG. 2 is a perspective view of a sunshade equipped with a rack-like member of the present invention on the main shaft thereof.
Figure 3:
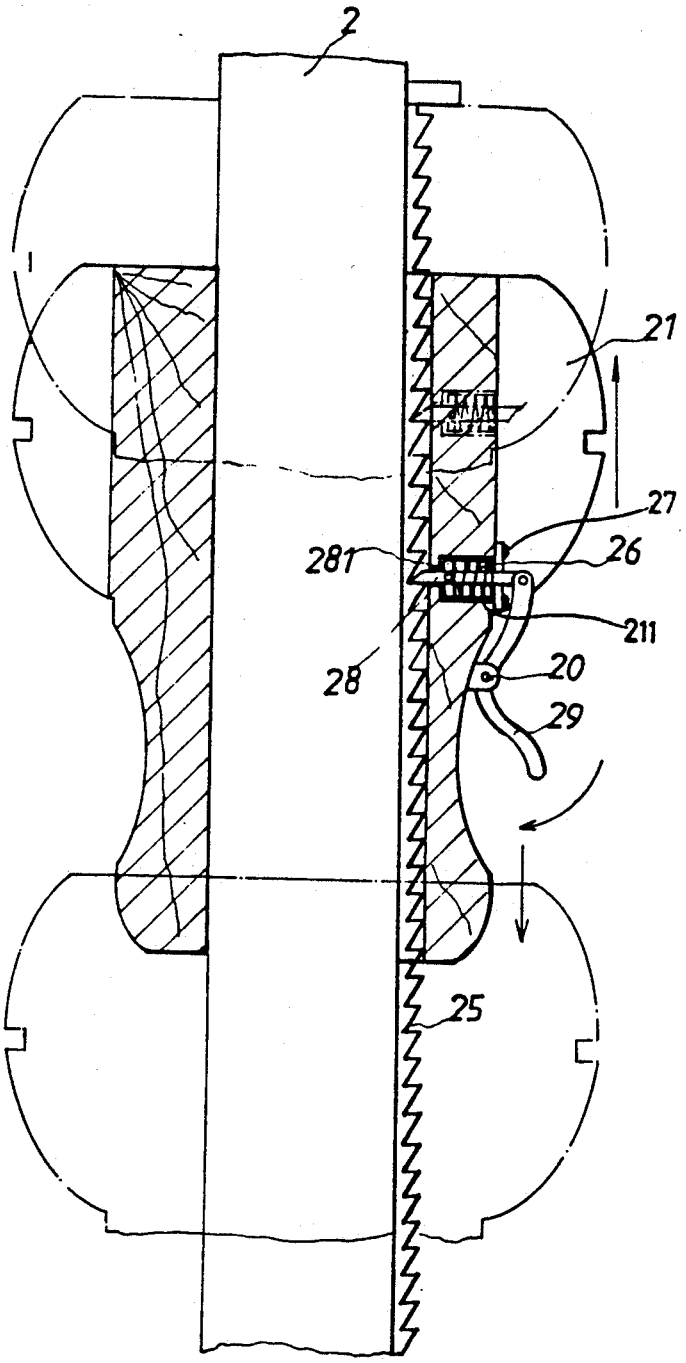
FIG. 3 is a diagram showing the detailed structure of a runner equipped with a spring biased supporting pin, connected to a pivotal arc arm at one end and received in a cavity disposed on the wall of the runner, which is retractably engaged with the rack-like member.

Referring to FIGS. 2, 2A, 3, the present invention is mainly characterized in a runner 21 slidably mounted onto the main shaft 2 of the sunshade; and a plurality of supporting ribs 22 are pivotally associated with the runner 21 at one end and are coupled to the middle of the frame ribs 23 at the other end thereof respectively. A canopy 24 is expandedly fixed in place with part of the rim thereof secured to the end of the frame ribs 23.

An elongated rack-like member 25 having a plurality of Z-shaped teeth 252 is disposed on a section of the main shaft 2. The length of the rack-like member 25 is equal to the distance in which the runner 21 travels from an opening position to a closing position along the main shaft 2. A horizontal stop piece 251 disposed at the topmost end of the rack-like member 25 is used to prevent the runner from disengagement with the member 25.

The rack-like member 25 is slidably engaged with a groove 221 disposed on the inner wall of the runner 21. An open-ended cavity 211 having a hole disposed at the front end thereof accommodates a spring 26 and a supporting pin 28 therein. The supporting pin 28 is provided with a restraint flange 281 at the front portion thereof so that the spring 26 can be fixed in place by abutment against the flange 281 at one end and against a lid 27 secured to the opened end of the cavity 211. The front tip of the supporting pin 28 led through the hole at the front end of the cavity 211 is selectively engaged with one of the teeth 252 of the rack-like member 25. The front tip of the supporting pin 28 is provided with an oblique face which is in parallel with the oblique face 253 of the Z-shaped teeth. The rear end of the supporting pin 28 led through a through hole on the lid is pivotally connected to an arc arm 29 which is pivotally fixed to a lug 20 disposed on the outer wall of the runner 21 whereby the actuation of the arm 29 will make the spring biased supporting pin 28 to separate from the rack-like member 25.

The operation of the present invention is described hereinafter. To get the sunshade opened, the runner 21 is pushed upwardly along the main shaft 2, the oblique face of the front tip of the the supporting pin 28 is in abutment against the oblique face 253 of the Z-shaped teeth 252 in the upward journey, resulting in the backward withdrawal of the supporting pin 28. During the process, the spring 26 is continuously compressed with the backward movement of the supporting pin 28 until the stop of the movement of the runner 21, the compressed spring will pop out when the runner 21 is located at a new position and retain the runner 21 in place so as to keep the sunshade opened. To close the sunshade, the arc arm 29 is pivotally triggered and held in place, resulting in the backward pulling of the supporting pin 28 so as to make the same separate from the locking tooth of the rack-like member 25, permitting the runner 21 to travel downwardly freely to collapse the sunshade.

It can be clearly seen the present invention enables a person to open the sunshade simply by pushing the runner upwardly which is equipped with a spring biased supporting pin along a rack-like member; the supporting pin will move against a Z-shaped tooth each time and will pop out and be retained in place when it passes over each tooth due to the help of a bias spring until the runner is located at a desired position so as to facilitate a person to open a heavy sunshade with no effort at all. To close or collapse the sunshade, a person only has to trigger and hold a pivotal arc arm which is pivotally connected to the end of the supporting pin, causing the spring biased supporting pin to withdraw from the engagement with the tooth of the rack-like member so as to permit the runner to slide down all the way, resulting in the collapse of the sunshade.

I claim:

1. An improved opening and supporting device adapted for a sunshade of the type comprising a main shaft, a runner, a plurality of supporting ribs and a plurality of frame ribs; said runner having an inner wall and an outer wall, and being slidably mounted onto said main shaft of the sunshade with said supporting ribs pivotally connected thereto, the other ends of said supporting ribs are pivotally associated with said frame ribs of said sunshade to which a canopy is attached; said opening and supporting device being characterized in that an elongated rack-like member is secured to a section of said main shaft, said runner slidably travels over said rack-like member during the opening and closing of the sunshade; said rack-like member having a topmost end and is provide with a plurality of Z-shaped teeth each of which has an oblique face; a horizontal stop piece is disposed at said topmost end of said rack-like member so as to prevent said runner from disengagement with said rack-like member; a groove disposed on said inner wall of said runner permits the slidable engagement of said rack-like member with said runner an arc arm and a lug being mounted on said runner; an open-ended cavity having a rear opened end and a front end, and being disposed on said runner; said cavity having a lid at said rear opened end and a through hole at said front end; said cavity accommodates a spring biased supporting pin having a front tip with an oblique face in parallel with said oblique face of said Z-shaped tooth; said supporting pin having a front portion and a rear end and being provided with a restraint flange at said front portion thereof so that a spring is confined between said flange and said lid, permitting said supporting pin to be retrievably actuated as the rear end of said supporting pin is pivotally connected to said arc arm wherein said arc arm being pivotally secured to said lug disposed on said outer wall of said runner whereby said supporting pin can automatically withdraw into said cavity when said runner is pushed against each tooth of said rack-like member, and can pop out to retain said runner in place when said supporting pin passes over each tooth repeatedly until said runner is moved to a desired position in the opening of said sunshade; said pivotal arc arm is triggered and held to make said supporting pin withdraw into said cavity for a short span of time so as to permit said supporting pin to slide downwardly in the closing of said sunshade.

* * * * *